US007487926B2

(12) United States Patent
Knol et al.

(10) Patent No.: US 7,487,926 B2
(45) Date of Patent: Feb. 10, 2009

(54) DISPERSION PLATE FOR DISPERSING A FLUID, METHOD FOR PRODUCING A DISPERSION PLATE AND USE OF A DISPERSION PLATE

(75) Inventors: Harm Gerrit Knol, Geesteren (NL); Ahmad Dawud Harbiye, Hilversum (NL)

(73) Assignee: Stork Veco B.V., Eerbeek (NL)

( * ) Notice: Subject to any disclaimer, the term of this patent is extended or adjusted under 35 U.S.C. 154(b) by 418 days.

(21) Appl. No.: 11/189,340

(22) Filed: Jul. 26, 2005

(65) Prior Publication Data

US 2006/0022070 A1 Feb. 2, 2006

(30) Foreign Application Priority Data

Jul. 30, 2004 (NL) ..... 1026752

(51) Int. Cl.
*B05B 1/00* (2006.01)

(52) U.S. Cl. ..... 239/596; 239/548; 239/556; 239/594; 239/595; 239/601

(58) Field of Classification Search ..... 239/596, 239/601, 592, 594, 595, 556, 102.1, 102.2, 239/543, 548; 347/47, 45
See application file for complete search history.

(56) References Cited

U.S. PATENT DOCUMENTS 3,441,223 A 4/1969 Lapera
4,465,234 A * 8/1984 Maehara et al. ..... 239/102.2
5,387,440 A * 2/1995 Takemoto et al. ..... 427/443.1
5,697,154 A 12/1997 Ogihara
6,341,836 B1 * 1/2002 Koike et al. ..... 347/20
6,826,833 B1 12/2004 Maier et al.
6,926,208 B2 * 8/2005 Ivri ..... 239/4

FOREIGN PATENT DOCUMENTS

| | | |
|---|---|---|
| DE | 195 04 882 | 8/1995 |
| WO | WO 96/22460 | 7/1996 |
| WO | WO 01/11229 | 2/2001 |

* cited by examiner

*Primary Examiner*—Dinh Q Nguyen
(74) *Attorney, Agent, or Firm*—Hoffman & Baron, LLP

(57) ABSTRACT

A dispersion plate for dispersing a fluid includes two surface sides, a peripheral side and at least one through-opening which extends between the two surface sides, the opening including an inlet on one surface side, a passage, and an outlet on the other surface side, and the inlet, the passage and the outlet being delimited by an opening wall of the dispersion plate. The inlet, the passage and the outlet have a common longitudinal axis, the part of the opening wall delimiting the passage being substantially parallel to the common longitudinal axis, and the part of the opening wall delimiting the outlet, from the passage to the surface side where the outlet is located, being divergent relative to the common longitudinal axis. A method for producing a dispersion plate by electroplating is also described.

4 Claims, 1 Drawing Sheet

DISPERSION PLATE FOR DISPERSING A FLUID, METHOD FOR PRODUCING A DISPERSION PLATE AND USE OF A DISPERSION PLATE

CROSS-REFERENCE TO RELATED APPLICATIONS

This application claims the benefit of Netherlands Application No. NL 1026752, filed Jul. 30, 2004, the contents of which is incorporated by reference herein.

FIELD OF THE INVENTION

The present invention relates to a dispersion plate for dispersing a fluid, comprising two surface sides, a peripheral side and at least one through-opening which extends between the two surface sides, the opening comprising an inlet on one surface side, a passage, and an outlet on the other surface side, and the inlet, the passage and the outlet being delimited by an opening wall of the dispersion plate.

BACKGROUND OF THE INVENTION

A dispersion plate is known from the international patent application WO-96/22460, in which a spray nozzle is disclosed which is composed of a number of layers, which layers have been obtained by electroforming, the passage causing a turbulence by being positioned such that the direction of the fluid stream of a fluid which flows from the inlet to the outlet is changed at least once, as is described in more detail on page 6, lines 10-17 of the application. This change in the flow direction results in turbulence of the fluid stream. Preferably the longitudinal axis of the passage is at right angles to the longitudinal axis of the inlet and outlet. A dispersion plate of this type improves the atomization of the fluid for the purpose of spraying it in the form of a mist (i.e. dispersion into small droplets). However, the structure of a dispersion plate of this type is relatively complex as a result of the multilayer construction and the directional differences of the longitudinal axes of the passage on the one hand and the inlet and the outlet on the other hand. In addition, a multilayer construction has the drawback that the layers are produced in stages during the production of the dispersion plate, in which case the positioning of the various layers relative to one another is critical, making the production process laborious and costly in order to minimize deviations in the positioning of the layers. Furthermore, there is a general demand for a dispersion plate which sprays a mist in a reproducible spraying direction and which sprays the mist in a conical manner suitable for its applications.

SUMMARY OF THE INVENTION

It is an object of the invention to partially or completely solve one or more of the abovementioned problems, in accordance with the abovementioned general demand.

To this end, the dispersion plate of the type mentioned in the introduction is characterized according to the invention in that the inlet, the passage and the outlet have a common longitudinal axis, the part of the opening wall delimiting the passage being substantially parallel to the common longitudinal axis, and the part of the opening wall delimiting the outlet, from the passage to the surface side where the outlet is located, being divergent relative to the common longitudinal axis. As a result of the opening wall running parallel with the common longitudinal axis at the passage, the diameter of the passage of an opening is virtually constant. The length of the passage (measured along the longitudinal axis) substantially determines the reproducibility of the spraying direction. The length of the outlet (measured along the longitudinal axis) substantially determines the conical shape of the sprayed mist. Thus, using a dispersion plate of this type at the outlet, it is possible to spray a mist in a reproducible spraying direction and in a divergent conical manner which is suitable for the intended applications, which will be described in more detail below. The dispersion plate can be in the form of any desired flat shape, for example a disc, and usually has more than one through-opening through which the fluid runs, for example four openings.

According to a preferred embodiment of the dispersion plate according to the invention, the part of the opening wall which delimits the inlet is mirror-symmetrical to the outlet relative to the longitudinal centre plane of the dispersion plate. This means that the course of the opening wall which delimits the outlet is congruent with the course of the opening wall which delimits the inlet, but that the inlet and/or outlet are located on opposite sides of the dispersion plate and their orientation is thus opposite. The advantage of a dispersion plate of this type is that it can be used from both sides for dispersing a fluid, since both sides have an outlet which diverges with respect to the longitudinal axis. This facilitates the incorporation of a dispersion plate in an assembly, since there is no distinguishable top or bottom side. In addition, it is easy to produce, as will become apparent below. The shape of the inlet is preferably a bell-mouth form because of pressure build-up when the spraying nozzle is made to vibrate, for example using a piezo.

With another preferred embodiment of the dispersion plate according to the invention, the part of the opening wall which delimits the outlet diverges in an arcuate manner, viewed in longitudinal section of the dispersion plate. The advantage of an arcuate shape is that the dispersion, i.e. the atomization of the fluid, is carried out well, in combination with a suitable conical shape of the sprayed mist.

Preferably, the dispersion plate according to the invention is arcuate with a constant radius. In addition to the abovementioned advantages, an arcuate shape of this nature also has the advantage that it can easily be formed by electroplating in an electroplating bath.

More preferably, with a dispersion plate according to the invention, the common longitudinal axis is substantially at right angles to the longitudinal centre plane of the dispersion plate. A dispersion plate of this type has the advantage that the spraying direction of the sprayed mist is at right angles to the plane of the dispersion plate itself, as a result of which the dispersion plate can easily be positioned at a desired angle when it is incorporated into an assembly.

Even more preferably, the dispersion plate according to the invention is provided in one piece. A dispersion plate in one piece is easy to produce compared to a dispersion plate which consists of a plurality of layers. Furthermore, the opening wall which delimits the inlet, the passage and the outlet forms a single part, as a result of which there are no discontinuous transition parts in the opening wall. A through-opening of this type ensures that the spraying direction of the mist is reproducible to an increased extent, as is the sprayed conical shape.

Advantageously, the dispersion plate is made from metal, preferably from nickel, due to its suitability for electroplating production methods.

According to a second aspect, the invention relates to a method for producing a dispersion plate, comprising two surface sides, a peripheral side and at least one through-opening which extends between two surface sides, the opening comprising an inlet on one surface side, a passage, and an outlet on the other surface side, and the inlet, the passage and the outlet being delimited by an opening wall of the dispersion plate, comprising the steps of:

a) providing a core material which comprises at least one through-opening, the opening being delimited by an opening wall made from the core material, the said opening having a longitudinal axis and the said opening wall being substantially parallel to the longitudinal axis, and b) depositing a growth layer on all sides of the core material in an electroplating bath.

Such a method has the advantage that it provides a simple way of producing a dispersion plate according to the first aspect of the invention, where the opening in the core material determines the shape of the passage of the opening in the dispersion plate, while the growth layer, which forms the outlet and the inlet of the opening, has a divergent shape relative to the longitudinal axis. In this manner, a dispersion plate according to the first aspect of the invention having the abovementioned advantages is obtained. In addition, the method has the advantage that no attention has to be paid to positioning the outlet and inlet relative to the passage as the entire opening wall is formed in one piece during a growth step.

Preferably, with the method according to the invention, providing the core material in step a) is carried out by electroforming a core material on a die, and the core material is removed from the die between steps a) and b). Such a method offers the advantage of simple production of a core material which is a suitable substrate for further growth, with a suitable shape of the through-opening. In electroforming the core material, it is grown on the die between electrically insulating islands of a resist layer, the shape of the islands determining the shape of the through-opening of the core material to be produced. With a thick resist layer, the core material grows in such a manner that the top side of the core material is flat, but this is not critical. The top side can also be undulating, angular, etc., as long as the opening wall is substantially parallel to the longitudinal axis of the opening. Advantageously, the longitudinal axis is at right angles to the longitudinal centre plane of the core material.

As an alternative to electroforming, the core material is provided by etching a plate-like material or by machining it with a laser.

According to a third aspect, the invention relates to the use of the dispersion plate according to the invention for dispersing a fluid. The advantage of this use is that a mist is sprayed, which has a reproducible direction and a divergent conical shape which is suitable for the intended applications, such as dispersing fuel, pesticide, insecticide, lacquer, aerosol, etc. The use is particularly advantageous when dispersing fuel in order to improve combustion in an internal-combustion engine.

According to a fourth aspect, the invention relates to a dispersing component for dispersing a fluid, in particular a fuel or fuel mixture, comprising a dispersion plate according to the invention, and a connecting piece for connecting the inlet of the opening of the dispersion plate to a fluid supply. Such a component may be fitted in an internal-combustion engine, at a position behind the inlet valve and in front of the combustion chamber. In this manner an improved spraying direction and conical shape of the mist are achieved, which improves the combustion of a fuel mixture which is sprayed by means thereof. Depending on the desired degree of dispersion, the diameter of an opening having a circular cross section is between 0.2 and 200 micrometers and the dispersion plate as a whole has a thickness of a few tenths of a millimeter. On the other hand, a component of this type may be useful in applications where the dispersion plate is used temporarily, for example as an attachment for a garden hose which is used to spray water with.

In addition, the invention relates to a dispensing device for dispersed matter, comprising a fluid container and an atomizer connected thereto, the atomizer comprising a dispersion plate according to the invention. A dispensing device of this type combines the advantages of the dispensing plate and a container for fluids, such as for example a spray can for aerosols, hair spray, paint, foam, etc.

BRIEF DESCRIPTION OF THE DRAWINGS

The invention will be explained below with reference to the following figures, in which.

DETAILED DESCRIPTION OF PREFERRED EMBODIMENTS

Figure 1:
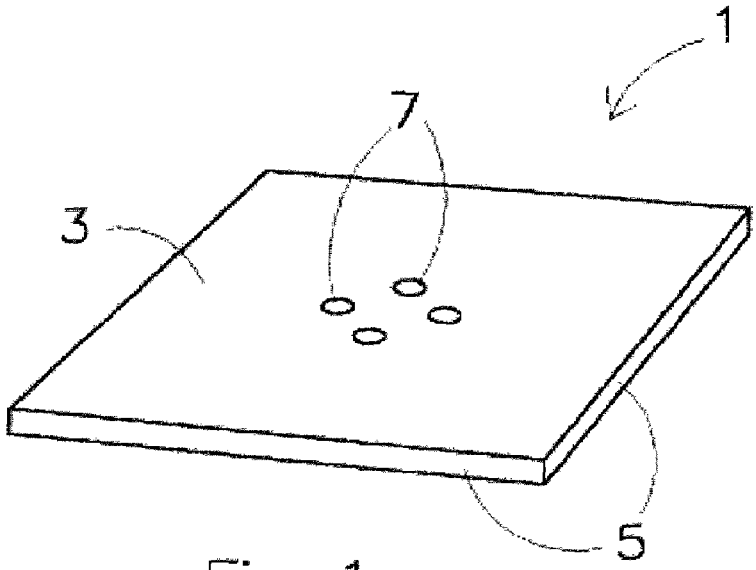
FIG. 1 shows a perspective view of a dispersion plate according to the invention.

FIG. 1 shows a perspective view of a dispersion plate 1 with a surface side 3 and an opposite surface side (not shown), a peripheral side 5 and four through-openings 7 which are equidistant from one another.

Figure 2:
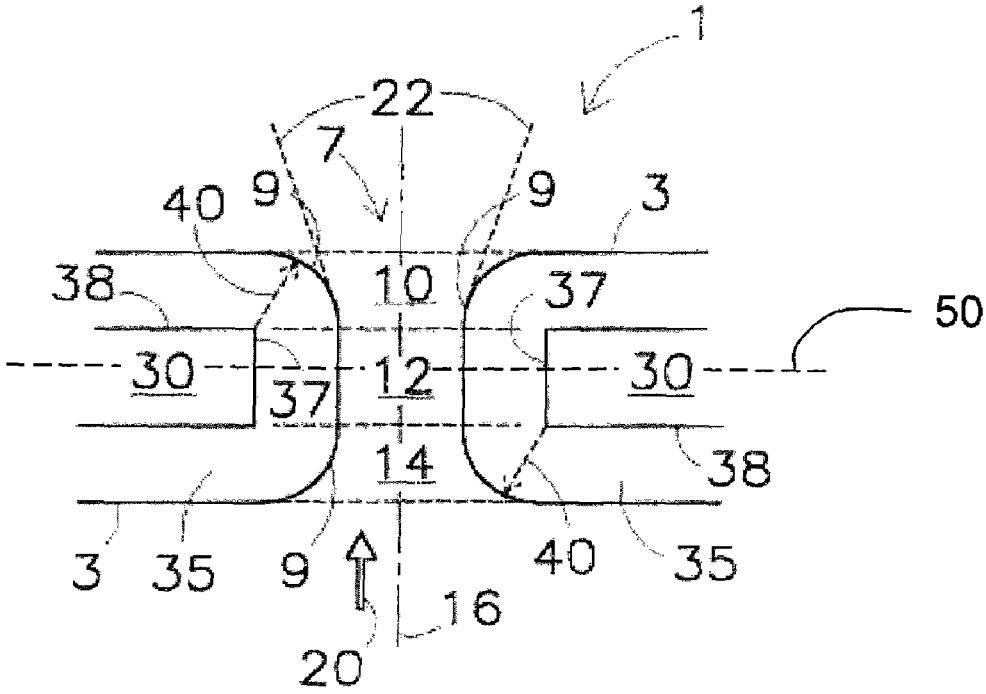
FIG. 2 shows a detailed view of a longitudinal section of an opening of a dispersion plate according to the invention.

FIG. 2 shows a part of a dispersion plate 1 in longitudinal section, with two opposite surface sides 3 and an opening 7. The opening 7 is surrounded by an opening wall 9 which delimits three parts of the opening, namely an outlet 10, a passage 12 and an inlet 14. A vertical construction line 16 is drawn in the opening 3, indicating the common longitudinal axis for the outlet 10, the passage 12 and the inlet 14. The direction of flow of the fluid is indicated by an arrow 20. Dashed lines 222 indicate the conical shape in which the mist is sprayed. The dispersion plate 1 is composed of a core material 30 and a growth layer 35 on all sides. The core material 30 has an opening wall 37 which is parallel to the longitudinal axis of the opening which was present in the original core material 30 prior to the growth layer 35 being applied. The common longitudinal axis is substantially at right angles to the longitudinal centre plane 50 of the dispersion plate 1. In this embodiment, the top and bottom surfaces 38 of the original core material 30 are flat. The growth layer 35 forms the opening wall 9, which runs parallel to the longitudinal axis 16 at the passage 12, and which has an arcuate shape with a constant radius at the inlet 14 and the outlet 10, indicated by means of a dashed arrow 40.

The following example is given in order to illustrate the method according to the invention for producing the dispersion plate.

A nickel core material is grown on an electroforming die with islands consisting of an electrically insulating resist layer having a thickness of 25 μm, from an electroplating bath of sulphamate nickel using an electric current of 100 A and applying a charge of 3000 Amin.

Next, the core material is removed from the die and a layer is grown on all sides of it in an electroplating bath, for example in a manner as described in European patent EP 0049022, in particular with reference to FIG. 2.

What is claimed is:

1. A dispersion plate for dispersing a fluid, the dispersion plate having a longitudinal centre plane and an opening wall, the dispersion plate comprising two surface sides, a peripheral side and at least one through-opening which extends between the two surface sides, the opening comprising an inlet on a first surface side of the two surface sides, a passage, and an outlet on a second surface side of the two surface sides, and the inlet, the passage and the outlet each being delimited by a part of the opening wall of the dispersion plate, wherein the inlet, the passage and the outlet have a common longitudinal axis, the part of the opening wall delimiting the passage being substantially parallel to the common longitudinal axis, and the part of the opening wall delimiting the outlet, from the passage to the surface side where the outlet is located, being divergent relative to the common longitudinal axis, wherein the part of the opening wall which delimits the inlet is mirror-symmetrical to the outlet relative to the longitudinal centre plane of the dispersion plate, and wherein the part of the opening wall which delimits the outlet diverges in an arcuate manner, viewed in longitundinal section of the dispersion plate.

2. The dispersion plate according to claim 1, wherein the arcuate shape has a constant radius.

3. The dispersion plate according to claim 1, wherein the common longitudinal axis is substantially at right angles to the longitudinal centre plane of the dispersion plate.

4. The dispersion plate according to claim 1, wherein the dispersion plate is provided in one piece.

* * * * *